US009047878B2

(12) United States Patent
Yamabe

(10) Patent No.: US 9,047,878 B2
(45) Date of Patent: Jun. 2, 2015

(54) SPEECH DETERMINATION APPARATUS AND SPEECH DETERMINATION METHOD

(75) Inventor: Takaaki Yamabe, Yokohama (JP)

(73) Assignee: JVC KENWOOD Corporation, Kanagawa-Ku, Yokohama-Shi, Kanagawa-Ken (JP)

( * ) Notice: Subject to any disclaimer, the term of this patent is extended or adjusted under 35 U.S.C. 154(b) by 780 days.

(21) Appl. No.: 13/302,040

(22) Filed: Nov. 22, 2011

(65) Prior Publication Data

US 2012/0130711 A1 May 24, 2012

(30) Foreign Application Priority Data

Nov. 24, 2010 (JP) ..... 2010-260798

(51) Int. Cl.

*G10L 21/00* (2013.01)
*G10L 25/93* (2013.01)
*G10L 25/78* (2013.01)
*G10L 25/18* (2013.01)

(52) U.S. Cl.

CPC ..... *G10L 25/78* (2013.01); *G10L 2025/783* (2013.01); *G10L 25/18* (2013.01)

(58) Field of Classification Search

CPC ..... G10L 25/78; G10L 25/81; G10L 25/84; G10L 25/87; G10L 25/93; G10L 19/22; G10L 25/18; G10L 25/21; G10L 25/783; G10L 2025/786

USPC ..... 704/208, 210, 214, 215

See application file for complete search history.

(56) References Cited

U.S. PATENT DOCUMENTS

| | | | | |
|---|---|---|---|---|
| 5,581,651 | A * | 12/1996 | Ishino et al. | 704/205 |
| 5,661,755 | A * | 8/1997 | Van De Kerkhof et al. | 375/242 |
| 5,742,734 | A * | 4/1998 | DeJaco et al. | 704/226 |
| 6,154,721 | A * | 11/2000 | Sonnic | 704/233 |
| 6,253,182 | B1 * | 6/2001 | Acero | 704/268 |
| 6,415,253 | B1 * | 7/2002 | Johnson | 704/210 |
| 2004/0125961 | A1 * | 7/2004 | Alessio et al. | 381/56 |
| 2004/0133421 | A1 * | 7/2004 | Burnett et al. | 704/215 |
| 2004/0215447 | A1 * | 10/2004 | Sundareson | 704/200.1 |
| 2005/0096898 | A1 * | 5/2005 | Singhal | 704/205 |
| 2005/0108542 | A1 * | 5/2005 | Kirovski et al. | 713/176 |
| 2006/0069551 | A1 * | 3/2006 | Chen et al. | 704/214 |
| 2012/0253813 | A1 * | 10/2012 | Katagiri | 704/254 |

FOREIGN PATENT DOCUMENTS

| | | |
|---|---|---|
| JP | 2004-272052 | 9/2004 |
| JP | 2009-294537 | 12/2009 |

* cited by examiner

*Primary Examiner* — Eric Yen

(74) *Attorney, Agent, or Firm* — Renner, Kenner, Greive, Bobak, Taylor & Weber

(57) ABSTRACT

A signal portion per frame is extracted from an input signal, thus generating a per-frame signal. The per-frame signal in the time domain is converted into a per-frame signal in the frequency domain, thereby generating a spectral pattern of spectra. It is determined whether an energy ratio is higher than a threshold level. The energy ratio is a ratio of each spectral energy to subband energy in a subband that involves the spectrum. The subband is involved in subbands into which a frequency band is separated with a specific bandwidth. It is determined whether the per-frame signal is a speech segment, based on a result of the determination. Average energy is derived in the frequency direction for the spectra in the spectral pattern in each subband. Subband energy is derived per subband by averaging the average energy in the time domain.

14 Claims, 6 Drawing Sheets

SPEECH DETERMINATION APPARATUS AND SPEECH DETERMINATION METHOD

CROSS-REFERENCE TO RELATED APPLICATIONS

This application is based on and claims the benefit of priority from the prior Japanese Patent Application No. 2010-260798 filed on Nov. 24, 2010, the entire content of which is incorporated herein by reference.

BACKGROUND OF THE INVENTION

The present invention relates to a speech determination apparatus and a speech determination method for detecting speech segments in an input signal.

A signal generated by capturing voices carries speech segments that involve the voices and non-speech segments that are pauses or breath with no voices. A speech (or voice) recognition system determines speech and non-speech segments for higher speech recognition rate and higher speech-recognition process efficiency. Mobile communication using mobile phones, transceivers, etc. switches the encoding process for input signals between speech and non-speech segments for higher coded rate and transfer efficiency. The mobile communication requires a real-time performance, hence demanding less delay in a speech-segment determination process.

A known speech-segment determination process with less delay detects speech segments, with the comparison between the flatness of a frequency distribution of a frame of an input signal and a threshold level. Another known speech-segment determination process with less delay detects speech segments, with cepstrum analysis to: derive harmonic data on a fundamental wave that involves the maximum number of harmonic overtone components from a frame of an input signal and; analyze the harmonic data and power data on energy in the frame (the power data indicating an energy level with respect to a threshold level) whether the harmonic and power data exhibit the feature of voices.

The known speech-segment determination processes are effective in an environment where noises are relatively small. However, the known processes tend to erroneously detect speech segments when noises become larger due to the fact the feature of voices is embedded in the noises. The feature of voices is, for example, the flatness of a frequency distribution (indicating how often peaks appear) of a frame of an input signal and the pitch (high tones).

Moreover, the cepstrum analysis requires to perform Fourier transform two times with a heavy processing load in the frequency domain, thus consuming much power. Thus, if the cepstrum analysis is employed in a battery-powered system such as mobile communication equipment, a higher-capacity battery is required for much power consumption, resulting in a higher cost, a bulkier system, etc.

SUMMARY OF THE INVENTION

A purpose of the present invention is to provide a speech determination apparatus and a speech determination method for detecting speech segments in an input signal even if there is relatively much noise.

The present invention provides a speech determination apparatus comprising: a frame extraction unit configured to extract a signal portion per frame having a specific duration from an input signal, thus generating a per-frame input signal; a spectrum generation unit configured to convert the per-frame input signal in a time domain into a per-frame input signal in a frequency domain, thereby generating a spectral pattern of spectra; a peak detection unit configured to determine whether an energy ratio is higher than a specific first threshold level, the energy ratio being a ratio of each spectral energy of the spectral pattern to subband energy in a subband that involves the spectrum, the subband being involved in a plurality of subbands into which the specific frequency band is separated with a specific bandwidth; a speech determination unit configured to determine whether the per-frame input signal is a speech segment, based on a result of the determination at the peak detection unit; a frequency averaging unit configured to derive average energy, in a frequency direction, of the spectra in the spectral pattern in each subband; and a time-domain averaging unit configured to derive subband energy for each subband by averaging the average energy in a time domain.

Moreover, the present invention provides a speech determination method comprising the steps of: extracting a signal portion per frame having a specific duration from an input signal, thus generating a per-frame input signal; converting the per-frame input signal in a time domain into a per-frame input signal in a frequency domain, thereby generating a spectral pattern of spectra; determining whether an energy ratio is higher than a specific first threshold level, the energy ratio being a ratio of each spectral energy of the spectral pattern to subband energy in a subband that involves the spectrum, the subband being involved in a plurality of subbands into which the specific frequency band is separated with a specific bandwidth; determining whether the per-frame input signal is a speech segment, based on a result of the determination; deriving average energy, in a frequency direction, of the spectra in the spectral pattern in each subband; and deriving subband energy for each subband by averaging the average energy in a time domain.

DETAILED DESCRIPTION OF PREFERRED EMBODIMENTS

Before describing embodiments according the present invention, the problems on the known speech-segment determination processes are discussed further in detail with respect to the attached drawings.

The known speech-segment determination processes have a problem of difficulty in the detection of acoustic characteristics of voices when the surrounding noises become larger in the environment where the voices are captured, thus tend to erroneously detect speech segments. Especially, the known speech-segment determination processes tend to erroneously detect speech segments in the conversation using mobile communication equipment, such as a mobile phone, a transceiver, etc. in an environment, such as an intersection with heavy traffic, a site under construction, and a factory in operation.

In the erroneous detection of speech segments: a speech segment may be erroneously determined as a non-speech segment to cause too much compression of an input signal in the speech segment; or a non-speech segment may be erroneously determined as a speech segment to cause inefficient coding, leading to trouble in conversation due to lowered sound quality.

Moreover, the known speech-segment determination processes have problems when employed in mobile communication equipment having a noise canceling function, with no encoding circuitry installed. In detail, when the speech segment determination is performed erroneously, noises cannot be canceled normally and hence it is very difficult for a communication partner to listen to the reproduced voices.

Figure 1:
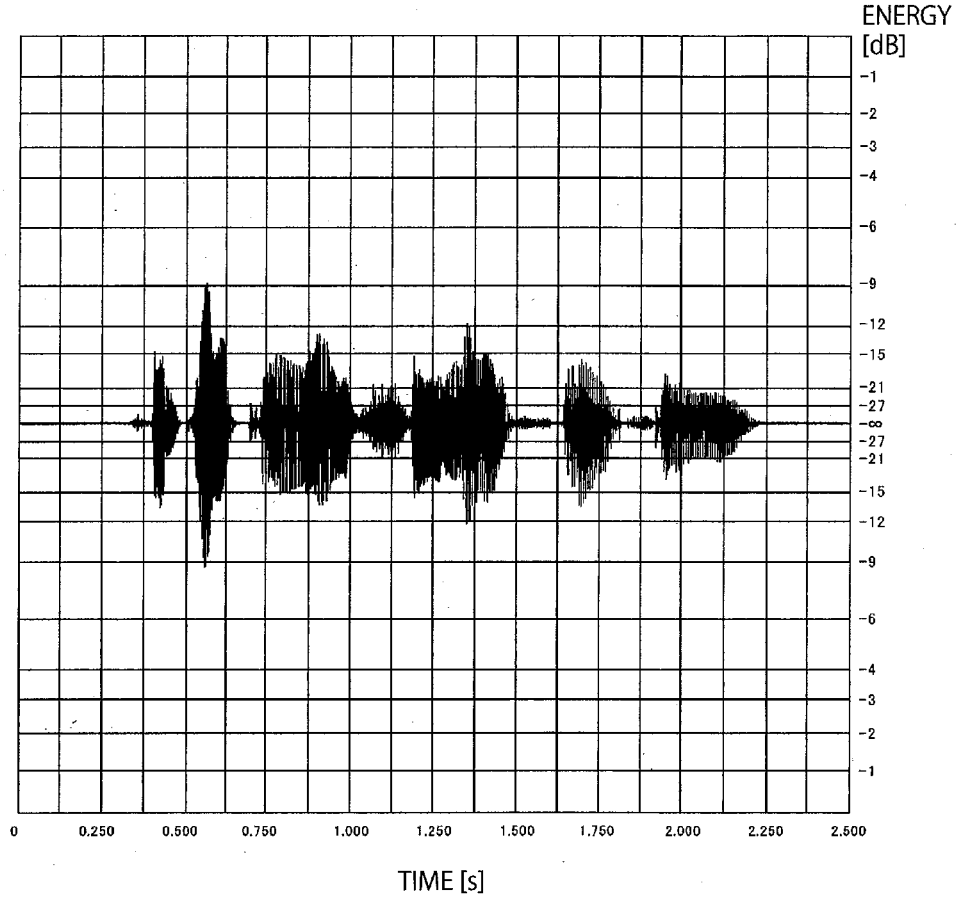
FIG. 1 is a view showing a waveform of a voice along the time axis.
Figure 2:
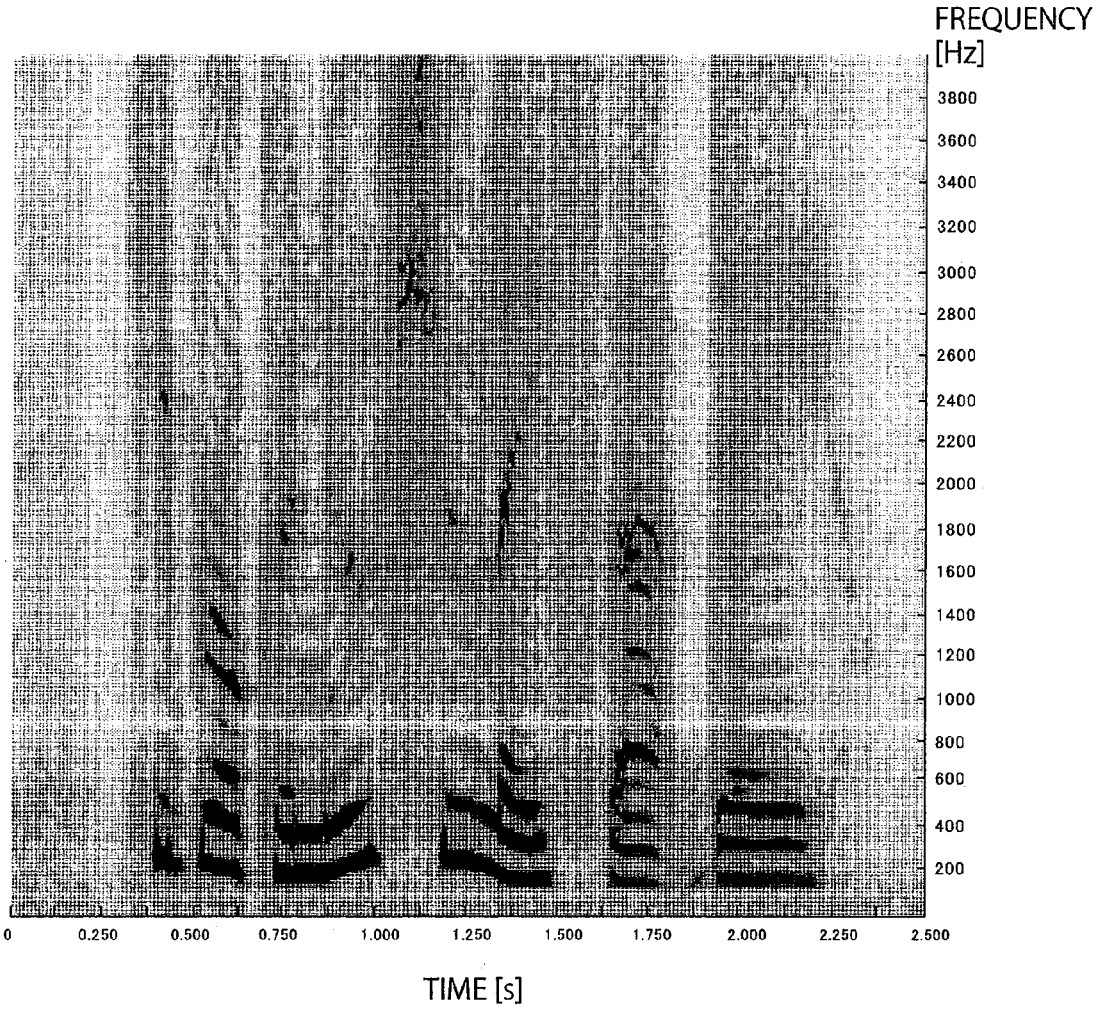
FIG. 2 is a view showing formants of the voice shown in FIG. 1.
Figure 3:
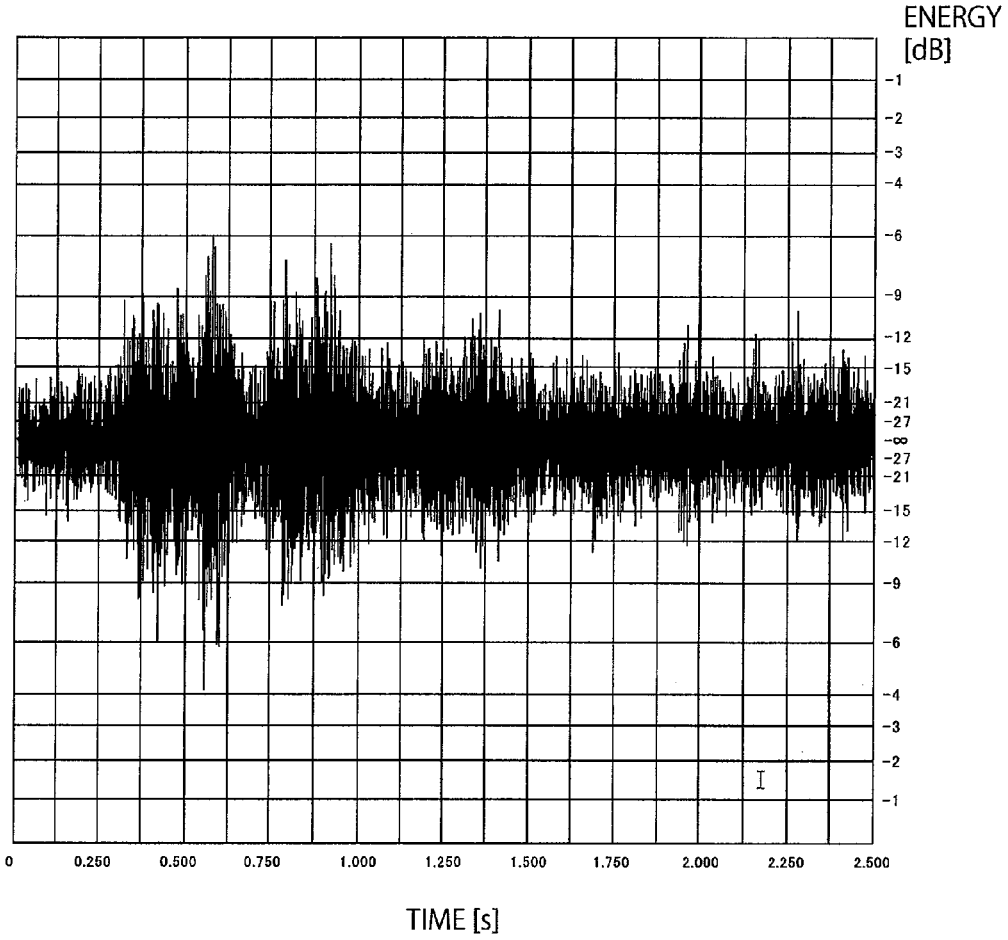
FIG. 3 is a view showing a waveform of a voice along the time axis in an environment with relatively much noise.
Figure 4:
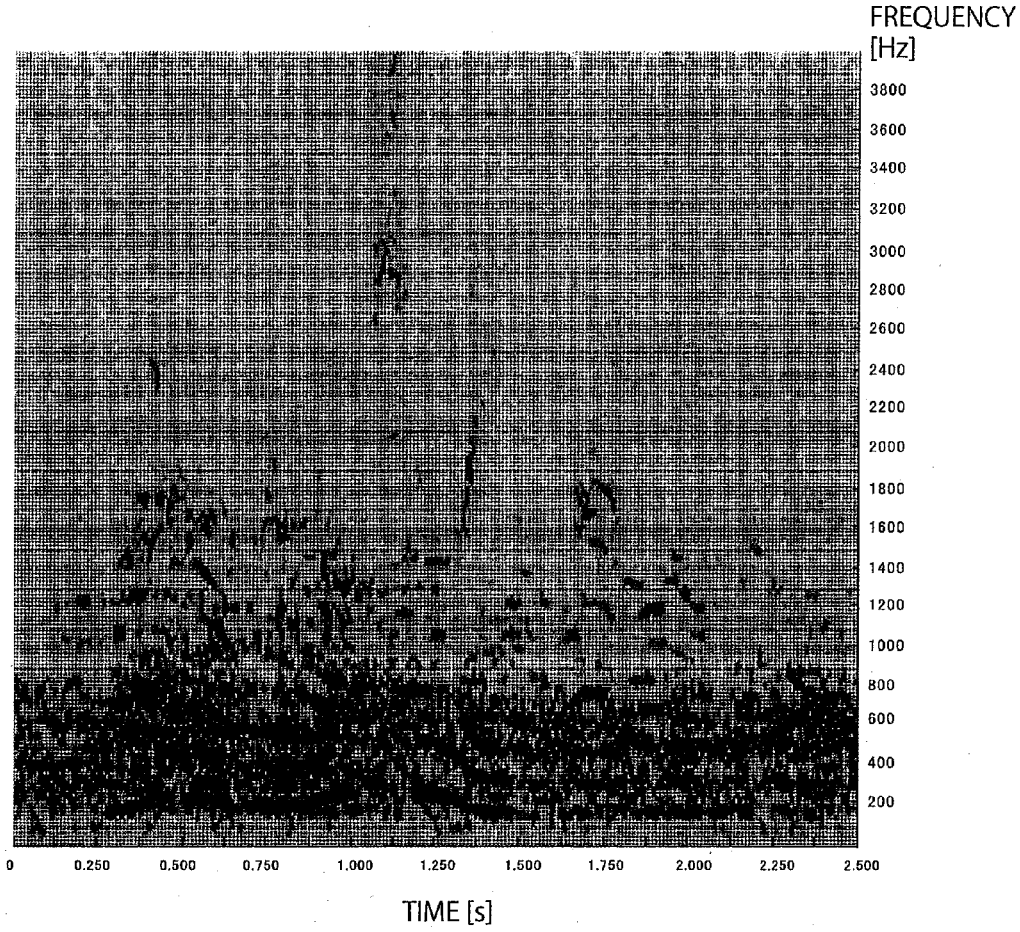
FIG. 4 is a view showing formants of the voice shown in FIG. 3.

The problems discussed above will be discussed further with reference to FIGS. 1 to 4. FIG. 1 is a view showing a waveform of a voice along the time axis. FIG. 2 is a view showing formants of the voice shown in FIG. 1. FIG. 3 is a view showing a waveform of a voice along the time axis in an environment with relatively much noise. FIG. 4 is a view showing formants of the voice shown in FIG. 3. The ordinate and abscissa in FIGS. 1 and 3 indicate energy (dB) and time (seconds), respectively. The ordinate and abscissa in FIGS. 2 and 4 indicate frequency (Hz) and time (seconds), respectively. The time axes in FIGS. 1 and 3 correspond to the time axes in FIGS. 2 and 4, respectively.

When the waveform of a voice with almost no noise shown in FIG. 1 is displayed in FIG. 2 with formants, a striped pattern that is the feature of the voice can easily be observed. However, when the waveform of a voice with surrounding noise shown in FIG. 3 is displayed in FIG. 4 with formants, there is no regularity of light and shade in the striped pattern, hence it is difficult to distinguish the striped pattern from the surrounding noise. If there is much surrounding noise as shown in FIG. 4, the striped pattern, the feature of the voice, is embedded in the surrounding noise. Thus, it is difficult to detect speech segments in the striped pattern by the known speech-segment determination processes with the cepstrum analysis or mere spectral peak detection.

There are several known processes for accurate detection of the feature of voices: a process of integrally adding a result of frequency analysis in a frame to that in the succeeding frame, over several frames in the time domain; a process for a wide area to be analyzed, with pattern recognition in syllables or phrases, for example; a process with autocorrelation requiring samples in the time domain for a long period of time, etc. However, these processes cause delay thus not suitable for mobile communication that requires smaller delay in a speech-segment determination process, as discussed above.

A battery-powered system, such as mobile communication equipment, requires less power consumption. Moreover, a digital ration communication system requires smaller delay, smaller processing load, less noise of a high energy level. However, if the cepstrum analysis is employed in these systems, it causes a heavier processing load and much power consumption, resulting in a higher cost, a bulkier system, etc.

In order to solve such problems, the present invention provides a speech determination apparatus and a speech determination method for accurately detecting speech segments in an input signal even if there is relatively much noise.

Embodiments of a speech determination apparatus and a speech determination method according to the present invention will be described with reference to the attached drawings.

(Speech Determination Apparatus 100)

Figure 5:
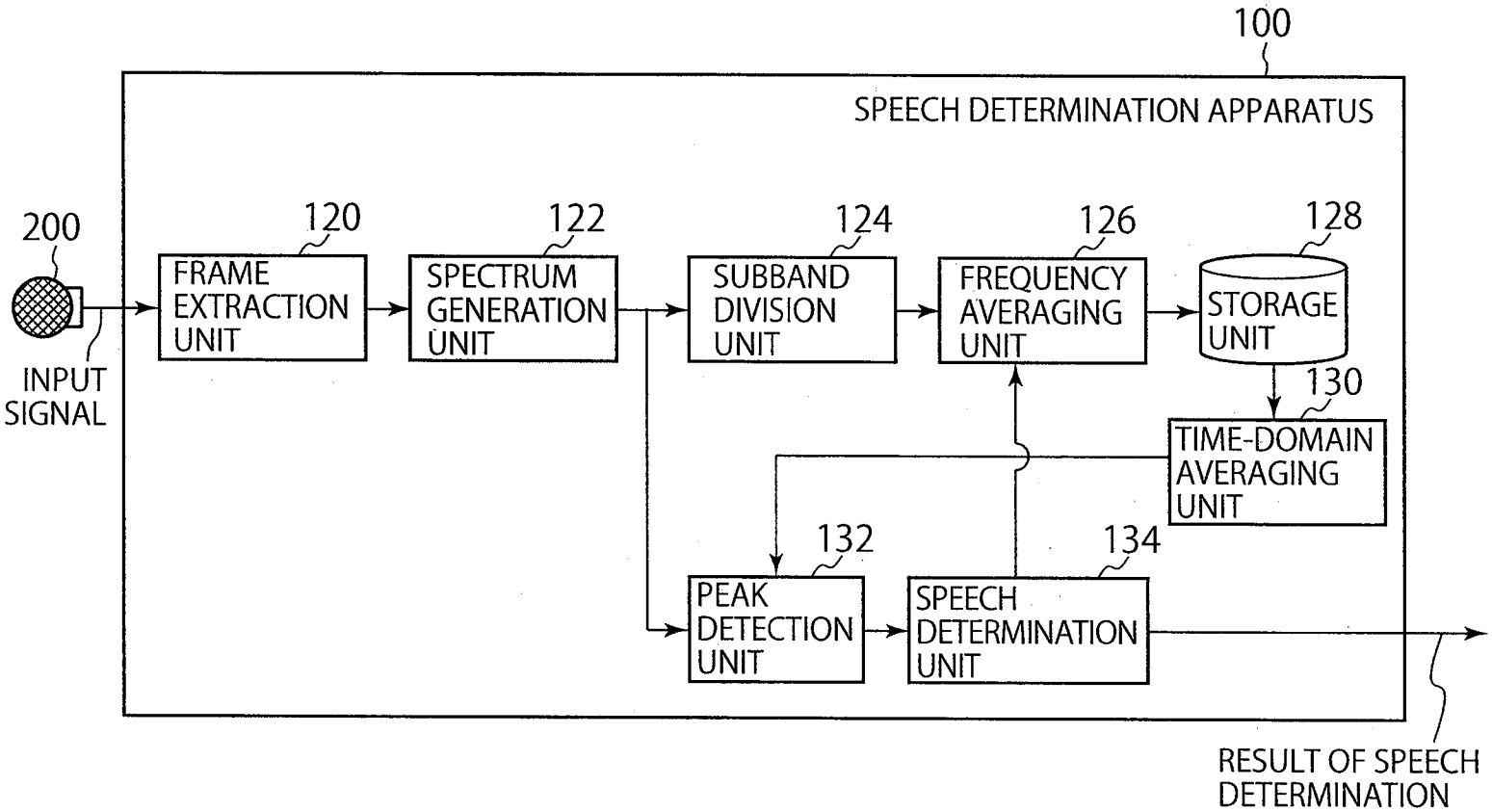
FIG. 5 is a view showing a functional block diagram for explaining a schematic configuration of a speech determination apparatus according to an embodiment of the present invention.

FIG. 5 is a view showing a functional block diagram for explaining a schematic configuration of a speech determination apparatus 100 according to an embodiment of the present invention.

The speech determination apparatus 100 is provided with a frame extraction unit 120, a spectrum generation unit 122, a subband division unit 124, a frequency averaging unit 126, a storage unit 128, a time-domain averaging unit 130, a peak detection unit 132, and a speech determination unit 134.

In FIG. 5, a sound capture device 200 captures a voice and converts it into a digital signal. The digital signal is input to the frame extraction unit 120. The frame extraction unit 120 extracts a signal portion for each frame having a specific duration corresponding to a specific number of samples from the input digital signal, to generate per-frame input signals. If the input signal to the frame extraction unit 120 from the sound capture device 200 is an analog signal, it can be converted into a digital signal by an A/D converter (not shown) provided before the frame extraction unit 120. The frame extraction unit 120 sends the generated per-frame input signals to the spectrum generation unit 122 one after another.

The spectrum generation unit 122 performs frequency analysis of the per-frame input signals to convert the per-frame input signals in the time domain into per-frame input signals in the frequency domain, thereby generating a spectral pattern. The spectral pattern is the collection of spectra having different frequencies over a specific frequency band. The technique of frequency conversion of per-frame signals in the time domain into the frequency domain is not limited to any particular one. Nevertheless, the frequency conversion requires high frequency resolution enough for recognizing speech spectra. Therefore, the technique of frequency conversion in this embodiment may be FFT (Fast Fourier Transform), DCT (Discrete Cosine Transform), etc. that exhibit relatively high frequency resolution.

In this embodiment, the spectrum generation unit 122 generates a spectral pattern in the range from at least 200 Hz to 700 Hz.

Spectra (referred to as formant, hereinafter) represent the feature of a voice and are to be detected in determining speech segments by the speech determination unit 134, which will be described later. The spectra generally involve a plurality of formants from the first formant corresponding to a fundamental pitch to the n-th formant (n being a natural number) corresponding to a harmonic overtone of the fundamental pitch. The first and second formants mostly exist in a frequency band below 200 Hz. This frequency band involves a low-frequency noise component with relatively high energy. Thus, the first and second formants tend to be embedded in the low-frequency noise component. A formant at 700 Hz or higher has low energy and hence also tends to be embedded in a noise component. Therefore, the determination of speech segments can be efficiently performed with a spectral pattern in a narrow range from 200 Hz to 700 Hz.

A spectral pattern generated by the spectrum generation unit 122 is sent to the subband division unit 124 and the peak detection unit 132.

The subband division unit 124 divides the spectral pattern into a plurality of subbands each having a specific bandwidth, in order to detect a spectrum unique to a voice for each appropriate frequency band. The specific bandwidth is in the range from 100 Hz to 150 Hz in this embodiment. Each subband covers about ten spectra.

The first formant of a voice is detected at a frequency in the range from about 100 Hz to 150 Hz. Other formants that are harmonic overtone components of the first formant are detected at frequencies, the multiples of the frequency of the first formant. Therefore, each subband involves about one formant in a speech segment when it is set to the range from 100 Hz to 150 Hz, thereby achieving accurate determination of a speech segment in each subband. On the other hand, if a subband is set wider than the range discussed above, it may involve a plurality of peaks of voice energy. Thus, a plurality of peaks may inevitably be detected in this single subband, which have to be detected in a plurality of subbands as the features of a voice, causing low accuracy in the determination of a speech segment. A subband set narrower than the range discussed above does not improve the accuracy in the determination of a speech segment but causes a heavier processing load.

The frequency averaging unit 126 acquires average energy for each subband sent from the subband division unit 124. In this embodiment, the frequency averaging unit 126 obtains the average of the energy of all spectra in each subband. Not only the spectral energy, the frequency averaging unit 126 can treat the maximum or average amplitude (the absolute value) of spectra for a smaller computation load.

The storage unit 128 is configured with a storage medium such as a RAM (Random Access Memory), an EEPROM (Electrically Erasable and Programmable Read Only Memory), a flash memory, etc. The storage unit 128 stores the average energy per subband for a specific number of frames (the specific number being a natural number N in this embodiment) sent from the frequency averaging unit 126. The average energy per subband is sent to the time-domain averaging unit 130.

The time-domain averaging unit 130 derives subband energy that is the average of the average energy derived by the frequency averaging unit 126 over a plurality of frames in the time domain. The subband energy is the average of the average energy per subband over a plurality of frames in the time domain. In this embodiment, the subband energy is treated as a standard noise level of noise energy in each subband. The average energy can be averaged to be the subband energy in the time domain with less drastic change. The time-domain averaging unit 130 performs a calculation according to an equation (1) shown below:

$$Eavr = \sum_{i=0}^{N} \frac{E(i)}{N} \tag{1}$$

where Eaver and E(i) are: the average of average energy over N frames; and average energy in each frame, respectively.

Instead of the subband energy, the time-domain averaging unit 130 may acquire an alternative value through a specific process that is applied to the average energy per subband of an immediate-before frame (which will be explained later) using a weighting coefficient and a time constant. In this specific process, the time-domain averaging unit 130 performs a calculation according to equations (2) and (3) shown below:

$$Eavr2 = \frac{\text{E_last} \times \alpha + \text{E_cur} \times \beta}{T} \tag{2}$$

where Eavr2, E_last, and E_cur are: an alternative value for subband energy; subband energy in an immediate-before frame that is just before a target frame that is subjected to a speech-segment determination process; and average energy in the target frame, respectively; and $$T = \alpha + \beta \tag{3}$$

where α and β are a weighting coefficient for E_last and E_cur, respectively, and T is a time constant.

Subband energy (a noise level for each subband) is stationary, hence is not necessarily quickly included in the speech-segment determination process for a target frame. Moreover, there is a case where, for a per-frame input signal that is determined as a speech segment by the speech determination unit 134, as described later, the time-domain averaging unit 130 does not include the energy of a speech segment in the derivation of suband energy or adjusts the degree of inclusion of the energy in the subband-energy derivation. For this purpose, suband energy is included in the speech-segment determination process for a target frame after the speech-segment determination for the frame just before the target frame at the speech determination unit 134. Accordingly, the subband energy derived by the time-domain averaging unit 130 is used in the segment determination at the speech determination unit 134 for a frame next to the target frame.

The peak detection unit 132 derives an energy ratio (SNR: Signal to Noise Ratio) of the energy in each spectrum in the spectral pattern (sent from the spectrum generation unit 122) to the subband energy (sent from the time-domain averaging unit 130) in a subband in which the spectrum is involved.

In detail, the peak detection unit 132 performs a calculation according to an equation (4) shown below, using the subband energy for which the average energy per subband has been included in the subband-energy derivation in the frame just before a target frame, to derive SNR per spectrum.

$$SNR = \frac{\text{E_spec}}{\text{Noise_Level}} \tag{4}$$

where SNR, E_spec, and Noise_Level are: a signal to noise ratio (a ratio of spectral energy to subband energy; spectral energy; and subband energy (a noise level in each subband), respectively.

It is understood from the equation (4) that a spectrum with SNR of 2 has a gain of about 6 dB in relation to the surrounding average spectra.

Then, the peak detection unit 132 compares SNR per spectrum and a predetermined first threshold level to determine whether there is a spectrum that exhibits a higher SNR than the first threshold level. If it is determined that there is a spectrum that exhibits a higher SNR than the first threshold level, the peak detection unit 132 determines the spectrum as a formant and outputs formant information indicating that a formant has been detected, to the speech determination unit 134.

On receiving the formant information, the speech determination unit 134 determines whether a per-frame input signal of the target frame is a speech segment, based on a result of determination at the peak detection unit 132. In detail, the speech determination unit 134 determines that a per-frame input signal is a speech segment when the number of spectra of this per-frame input signal that exhibit a higher SNR than the first threshold level is equal to or larger than a first specific number.

Suppose that average energy is derived for all frequency bands of a spectral pattern and averaged in the time domain to acquire a noise level. In this case, even if there is a spectral peak (formant) in a band with a low noise level and that should be determined as a speech segment, the spectrum is inevitably determined as a non-speech segment when compared to a high noise level of the average energy. This results in erroneous determination that a per-frame input signal that carries the spectral peak is a non-speech segment.

To avoid such erroneous determination, the speech determination apparatus 100 derives subband energy for each subband. Therefore, the speech determination unit 134 can accurately determine whether there is a formant in each subband with no effects of noise components in other subbands.

Moreover, the speech determination apparatus 100 employs a feedback mechanism with average energy of spectra in subbands in the time domain derived for a current frame, for updating subband energy for the speech-segment determination process to the frame following to the current frame. The feedback mechanism provides subband energy that is the energy averaged in the time domain, that is stationary noise energy.

As discussed above, there is a plurality of formants from the first formant to the n-th formant that is a harmonic overtone component of the first formant. Therefore, there is a case where, even if some formants are embedded in noises of a higher level, or higher subband energy in any subband, other formants are detected. In particular, surrounding noises are converged into a low frequency band. Therefore, even if the first formant (corresponding to a fundamental pitch) and the second formant (corresponding to the second harmonic of the fundamental pitch) are embedded in low frequency noises, there is a possibility that formants of the third harmonic or higher are detected.

Accordingly, the speech determination unit 134 can determine that a per-frame input signal is a speech segment when the number of spectra of this per-frame input signal that exhibit a higher SNR than the first threshold level is equal to or larger than the first specific number. This achieves noise-robust speech segment determination.

The peak detection unit 132 may vary the first threshold level depending on subband energy and subbands. For example, the peak detection unit 132 may be equipped with a table listing threshold levels corresponding to a specific range of subbands and subband energy. Then, when a subband and subband energy are derived for a spectrum to be subjected to the speech determination, the peak detection unit 132 looks up the table and sets a threshold level corresponding to the derived subband and subband energy to the first threshold level. With this table in the peak detection unit 132, the speech determination unit 134 can accurately determine a spectrum as a speech segment in accordance with the subband and subband energy, thus achieving further accurate speech segment determination.

Moreover, when the number of spectra of a per-frame input signal that exhibit a higher SNR than the first threshold level reaches the first specific number, the peak detection unit 132 may stop the SNR derivation and the comparison between SNR and the first threshold level. This makes possible a smaller processing load to the peak detection unit 132.

Moreover, the speech determination unit 134 may output a result of the speech segment determination process to the time-domain averaging unit 130 to avoid the effects of voices to subband energy to raise the reliability of speech segment determination, as explained below.

There is a high possibility that a spectrum is a formant when the spectrum exhibits a higher SNR than the first threshold level. Moreover, voices are produced by the vibration of the vocal cords, hence there are energy components of the voices in a spectrum with a peak at the center frequency and in the neighboring spectra. Therefore, it is highly likely that there are also energy components of the voices on spectra before and after the neighboring spectra. Accordingly, the time-domain averaging unit 130 excludes these spectra at once to eliminate the effects of voices from the derivation of subband energy.

Moreover, if noises that exhibit an abrupt change are involved in a speech segment and a spectrum with the noises is included in the derivation of subband energy, it gives adverse effects to the estimation of noise level. However, the time-domain averaging unit 130 can also detect and remove such noises in addition to a spectrum that exhibits a higher SNR than the first threshold level and surrounding spectra.

In detail, the speech determination unit 134 outputs information on a spectrum exhibiting a higher SNR than the first threshold level to the time-domain averaging unit 130. This is not shown in FIG. 5 because of an option. Then, the time-domain averaging unit 130 derives subband energy per subband based on the energy obtained by multiplying average energy by an adjusting value of 1 or smaller. The average energy to be multiplied by the adjusting value is the average energy of a subband involving a spectrum that exhibits a higher SNR than the first threshold level or of all subbands of a per-frame input signal that involves such a spectrum of a high SNR.

The reason for multiplication of the average energy by the adjusting value is that the energy of voices is relatively greater than that of noises, and hence subband energy cannot be correctly derived if the energy of voices is included in the subband energy derivation.

The time-domain averaging unit 130 with the multiplication described above can derive subband energy correctly with less effect of voices.

The speech determination unit 134 may be equipped with a table listing adjusting values of 1 or smaller corresponding to a specific range of average energy so that it can look up the table to select an adjusting value depending on the average energy. Using the adjusting value from this table, the time-domain averaging unit 130 can decrease the average energy appropriately in accordance with the energy of voices.

Moreover, the technique described below may be employed in order to include noise components in a speech segment in the derivation of subband energy depending on the change in magnitude of surrounding noises in the speech segment.

In detail, the frequency averaging unit 126 excludes a particular spectrum or particular spectra from the average-energy deviation. The particular spectrum is a spectrum that exhibits a higher SNR than the first threshold level. The particular spectra are a spectrum that exhibits a higher SNR than the first threshold level and the neighboring spectra of this spectrum.

In order to perform the derivation of average energy with the exclusion of spectra described above, the speech determination unit 134 outputs information on a spectrum exhibiting a higher SNR than the first threshold level to the frequency averaging unit 126. Then, the frequency averaging unit 126 excludes a particular spectrum or particular spectra from the average-energy derivation. The particular spectrum is a spectrum that exhibits a higher SNR than the first threshold level. The particular spectra are a spectrum that exhibits a higher SNR than the first threshold level and the neighboring spectra of this spectrum. And, the frequency averaging unit 126 derives average energy per subband for the remaining spectra. The derived average energy is stored in the storage unit 128. Based on the stored average energy, the time-domain averaging unit 130 derives subband energy.

In this embodiment, the speech determination unit 134 outputs information on a spectrum exhibiting a higher SNR than the first threshold level to the frequency averaging unit 126. Then, the frequency averaging unit 126 excludes particular average energy from the average-energy derivation. The particular average energy is the average energy of a spectrum that exhibits a higher SNR than the first threshold level or the average energy of this spectrum and the neighboring spectra. And, the frequency averaging unit 126 derives average energy per subband for the remaining spectra. The derived average energy is stored in the storage unit 128.

The time-domain averaging unit 130 acquires the average energy stored in the storage unit 128 and also the information on the spectra that exhibit a higher SNR than the first threshold level. Then, the time-domain averaging unit 130 derives subband energy for the current frame, with the exclusion of particular average energy from the averaging in the time domain (in the subband-energy derivation). The particular average energy is the average energy of a subband involving a spectrum that exhibits a higher SNR than the first threshold level or the average energy of all subbands of a per-frame input signal that involves a spectrum that exhibits a higher energy ratio than the first threshold level. The time-domain averaging unit 130 keeps the derived subband energy for the frame that follows the current frame.

In this case, when using the equation (1), the time-domain averaging unit 130 disregards the average energy in a subband that is to be excluded from the subband-energy derivation or in all subbands of a per-frame input signal that involves a subband that is to be excluded from the subband-energy derivation and derives subband energy for the succeeding subbands. When using the equation (2), the time-domain averaging unit 130 temporarily sets T and 0 to $\alpha$ and $\beta$, respectively, in substituting the average energy in the subband or in all subbands discussed above, for E_cur.

As discussed above, there is a high possibility that a spectrum is a formant and also the surrounding spectra are formants when this spectrum exhibits a higher SNR than the first threshold level. The energy of voices may affect not only a spectrum, in a subband, that exhibits a higher SNR than the first threshold level but also other sepectra in the subband. The effects of voices spread over a plurality of subbands, as a fundamental pitch or harmonic overtones. Thus, even if there is only one spectrum, in a subband of a per-frame input signal, that exhibits a higher SNR than the first threshold level, the energy components of voices may be involved in other subbands of this input signal. However, the time-domain averaging unit 130 excludes this subband or the per-frame input signal involving this subband from the subband-energy derivation, thus not updating the subband energy at the frame of this input signal. In this way, the time-domain averaging unit 130 can eliminate the effects of voices to the subband energy.

The speech determination unit 134 may be installed with a second threshold level, different from (or unequal to) the first threshold level, to be used for determining whether to include average energy in the averaging in the time domain (in the subband acquisition). In this case, the speech determination unit 134 outputs information on a spectrum exhibiting a higher SNR than the second threshold level to the frequency averaging unit 126. Then, the frequency averaging unit 126 does not derive the average energy of a subband involving a spectrum that exhibits a higher SNR than the second threshold level or of all subbands of a per-frame input signal that involves a spectrum that exhibits a higher energy ratio than the second threshold level. Accordingly, the time-domain averaging unit 130 does not include the average energy discussed above in the averaging in the time domain (in the subband energy acquisition).

Accordingly, using the second threshold level, the speech determination unit 134 can determine whether to include average energy in the averaging in the time domain at the time-domain averaging unit 130, separately from the speech segment determination process.

The second threshold level can be set higher or lower than the first threshold level for the processes of determination of speech segments and inclusion of average energy in the averaging in the time domain, performed separately from each other for each subband.

Described first is that the second threshold level is set higher than the first threshold level. The speech determination unit 134 determines that there is no speech segment in a subband if the subband does not involve a spectrum exhibiting a higher energy ratio than the first threshold level. In this case, the speech determination unit 134 determines to include the average energy in that subband in the averaging in the time domain at the time-domain averaging unit 130. On the contrary, the speech determination unit 134 determines that there is a speech segment in a subband if the subband involves a spectrum exhibiting an energy ratio higher than the first threshold level but equal to or lower than the second threshold level. In this case, the speech determination unit 134 also determines to include the average energy in that subband in the averaging in the time domain at the time-domain averaging unit 130. However, the speech determination unit 134 determines that there is a speech segment in a subband if the subband involves a spectrum exhibiting a higher energy ratio than the second threshold level. In this case, the speech determination unit 134 determines not to include the average energy in that subband in the averaging in the time domain at the time-domain averaging unit 130.

Described next is that the second threshold level is set lower than the first threshold level. The speech determination unit 134 determines that there is no speech segment in a subband if the subband does not involve a spectrum exhibiting a higher energy ratio than the second threshold level. In this case, the speech determination unit 134 determines to include the average energy in that subband in the averaging in the time domain at the time-domain averaging unit 130. Moreover, the speech determination unit 134 determines that there is no speech segment in a subband if the subband involves a spectrum exhibiting an energy ratio higher than the second threshold level but equal to or lower than the first threshold level. In this case, the speech determination unit 134 determines not to include the average energy in that subband in the averaging in the time domain direction at the time-domain averaging unit 130. Furthermore, the speech determination unit 134 determines that there is a speech segment in a subband if the subband involves a spectrum exhibiting a higher energy ratio than the first threshold level. In this case, the speech determination unit 134 also determines not to include the average energy in that subband in the averaging in the time domain at the time-domain averaging unit 130.

As described above, using the second threshold level different from the first threshold level, the time-domain averaging unit 130 can derive subband energy more appropriately.

As understood from FIG. 1 that a voice energy level is high in a time zone of voices. If subband energy is affected by the voice energy, speech determination is inevitably performed based on subband energy higher than an actual noise level, resulting in a bad result. In order to avoid such a problem, the speech determination apparatus 100 controls the effects of voice energy to subband energy after speech segment determination to accurately detect formants while preserving correct subband energy.

(Speech Determination Method)

Described next is a speech determination method to determine whether an input signal is a speech segment through the analysis of the input signal at the speech determination apparatus 100 described above.

Figure 6:
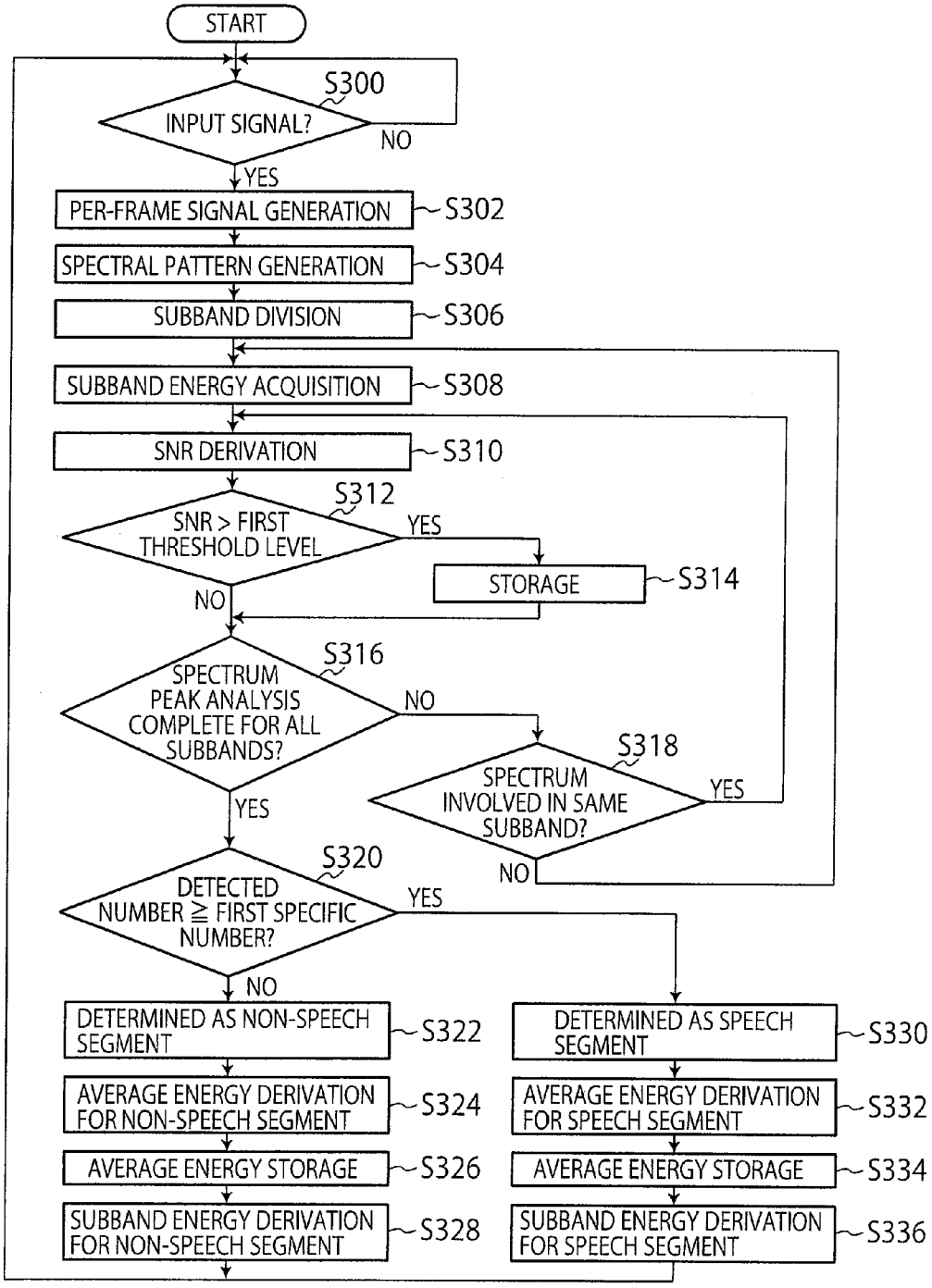
FIG. 6 is a view showing a flow chart for explaining a speech determination method according to an embodiment of the present invention.

FIG. 6 is a view showing a flow chart indicating the entire flow of the speech determination method.

When there is an input signal (Yes in step S300), the frame extraction unit 120 extracts a signal portion per frame from an input digital signal acquired by the speech determination apparatus 100, thus generating per-frame input signals (step S302).

The spectrum generation unit 122 performs frequency analysis of the per-frame input signals to convert the per-frame input signals in the time domain into per-frame input signals in the frequency domain, thereby generating a spectral pattern (step S304).

The subband division unit 124 divides the spectral pattern into plurality of subbands (step S306).

The peak detection unit 132 acquires subband energy in each subband from the time-domain averaging unit 130 (step S308). In this embodiment, the peak detection unit 132 acquires subband energy from a lower frequency to a higher frequency of the divided subbands.

The subband energy acquired in step S308 is the subband energy of the current frame updated in the subband-energy acquisition for the frame immediately before the current frame, after the start of the speech determination process. The subband energy is a noise level per subband averaged in the time or time domain at a specific time interval, without involving the energy of a spectrum of a per-frame input signal for which the speech determination process is not performed yet.

With a noise level that is the subband energy derived for a current frame updated from the frame immediately before the current frame, the noise level ratio of the energy of a spectrum in the current frame can be accurately derived. It is therefore possible to analyze whether a spectrum to be subjected to the speech determination process exhibits peak characteristics with respect to the surrounding spectra.

Next, in step S310, the peak detection unit 132 derives SNR that is an energy ratio of energy of a spectrum (from the spectrum generation unit 122), that is spectral energy, in a subband corresponding to the derived subband energy to the subband energy acquired in step S308. The spectrum for which SNR is derived is the spectrum of the lowest frequency among spectra for which SNR has not been derived yet.

Then, the peak detection unit 132 compares the derived SNR and the first threshold level (step S312). If there is a spectrum that exhibits a higher SNR than the first threshold level, or there is a spectrum that exhibits peak characteristics (Yes in step S312), the peak detection unit 132 stores information indicating, for example, a frequency of a spectrum that exhibits a higher SNR than the first threshold level in its own work area (step S314). Numeric conversion (modeling) may be applied to the magnitude of the peak characteristics and a result of numeric conversion may be stored in the work area of the peak detection unit 132. With the magnitude of the peak characteristics as a speech-segment determination standard, even if there are many formants embedded in noises in all formants, the remaining high formants can be determined as a speech segment.

Numeric conversion described above is to convert the magnitude of the peak characteristics of a spectrum into a numeric value and store the numeric value in the work area (for example, a buffer) of the peak detection unit 132. In a simple way of numeric conversion, the number of times that the SNR is detected as higher than the first threshold value is counted.

In this embodiment, the spectrum generation unit 122 generates a spectral pattern in the range from at least 200 Hz to 700 Hz. Not only that, it is also possible that: the spectrum generation unit 122 generates a spectral pattern in a wider range than that from 200 Hz to 700 Hz; and then the peak detection unit 132 focuses on the range from 200 Hz to 700 Hz in spectral peak analysis (the SNR deviation and comparison between SNR and the first threshold level), not for all bands of a spectral pattern.

Next in step S316, the peak detection unit 132 determines whether the spectral peak analysis has been performed for all subbands. If not (No in step S316), the peak detection unit 132 determines whether a succeeding spectrum (that is to be subjected to the spectral peak analysis) that follows the current spectrum is involved in the same subband as the current spectrum (S318). If not (No in step S318), the process returns to the subband-energy acquisition in step S308. On the other hand, if the succeeding spectrum is involved in the same subband as the current spectrum (Yes S318), the process returns to the SNR deviation in step S310.

When the spectral peak analysis has been performed for all subbands (Yes in step S316), the speech determination unit 134 acquires a result of the spectral peak analysis from the peak detection unit 132 and determines whether the number of spectra that exhibit a higher SNR than the first threshold level is equal to or larger than the first specific number (step S320).

If the number of spectra that exhibit a higher SNR than the first threshold level is smaller than the first specific number (No in step S320), the speech determination unit 134 determines that a per-frame input signal of a target frame is a non-speech segment (Step S322).

As described above, the peak detection unit 132 may apply numeric conversion to the magnitude of the peak characteristics and store a result of numeric conversion in its own work area, in the storage step S314. In this case, the speech determination unit 134 may compare the result of numeric conversion and a predetermined threshold value to determine whether a per-frame input signal of a target frame is a speech segment.

As described above, numeric conversion is to convert the magnitude of the peak characteristics of a spectrum into a numeric value and store the numeric value in the work area (for example, a buffer) of the peak detection unit 132. In a simple way of numeric conversion, the number of times that the SNR is detected as higher than the first threshold value is counted.

Moreover, when it is determined that the per-frame input signal of the target frame is a non-speech segment, the frequency averaging unit 126 derives average energy per subband using a spectrum pattern generated by the spectrum generation unit 122 (step S324) and stores the average energy in the storage unit 128 (step S326).

Even involving stationary noises, the change in energy appears if the analysis is performed for a shorter time. For this reason, in order to keep subband energy at an almost real noise level, the average energy is averaged further for each subband using the average energy derived before.

In detail, the time-domain averaging unit 130 acquires the average energy stored in the storage unit 128, derives subband energy that is the average of the average energy over a plurality of frames including the current frame in the time domain, and keeps the subband energy for the succeeding frame (step S328). The subband energy for the succeeding frame is the subband energy acquired by the peak detection unit 132 for the succeeding frame in step S308.

On the other hand, if the number of spectra that exhibit a higher SNR than the first threshold level is equal to or larger than the first specific number (Yes in step S320), the speech determination unit 134 determines that the per-frame input signal of the target frame is a speech segment (step S330).

Following to step S330, the frequency averaging unit 126 excludes a particular spectrum or particular spectra from the average-energy derivation, derives average energy for the remaining spectra per subband (step S332), and stores the average energy in the storage unit 128 (step S334). The particular spectrum in step S332 is a spectrum that exhibits a higher SNR than the first threshold level. The particular spectra in step S334 are a spectrum that exhibits a higher SNR than the first threshold level and the neighboring spectra of this spectrum.

Then, the time-domain averaging unit 130 acquires the average energy stored in the storage unit 128, derives subband energy up to the current frame, and keeps the subband energy for the succeeding frame with a technique under consideration of the effect of a speech segment (step S336). The subband energy for the succeeding frame is the subband energy acquired by the peak detection unit 132 for the succeeding frame in step S308. This technique is discussed in detail. The time-domain averaging unit 130 keeps the subband energy of the frame immediately before the current frame that is the target frame of the speech-segment determination process, with no energy of voices of the target frame being involved. Moreover, it may be performed to follow the temporal change in the surrounding noises and include the received surrounding noises superposed on voices in the subband-energy derivation. In this case, the time-domain averaging unit 130 may derive subband energy per subband based on the energy obtained by multiplying average energy by an adjusting value of 1 or smaller. The average energy to be multiplied by the adjusting value is the average energy of a subband determined as a speech segment or of all subbands of a per-frame input signal involving this subband.

Moreover, the time-domain averaging unit 130 may exclude the average energy of a particular subband (or particular subbands) from the averaging in the time domain (in the subband acquisition). The particular subband is the subband involving a spectrum that exhibits a higher energy ratio than the second threshold level. The particular subbands are all subbands of a per-frame input signal that involves a spectrum that exhibits a higher energy ratio than the second threshold level.

As described above, it is possible to detect speech segments in an input signal through the speech determination method, even if there is relatively much noise.

Encoding, noise cancellation, etc. can be performed after speech segments are detected in an input signal through the speech determination apparatus or method described above. In the case of encoding, a compression ratio can be raised with less deterioration of sound quality because of the processes of the determination apparatus or method described above. In the case of noise cancellation, noises can be cancelled efficiently because of the processes of the determination apparatus or method described above.

It is further understood by those skilled in the art that the foregoing description is a preferred embodiment of the disclosed apparatus or method and that various changes and modifications may be made in the invention without departing from the spirit and scope thereof.

Moreover, the steps shown in the flow chart of FIG. 6 may not necessarily be performed in the order shown in FIG. 6 and additional steps may be included as parallel with the steps or in a subroutine.

As described above in detail, the present invention provides a speech determination apparatus and a speech determination method for detecting speech segments in an input signal even if there is relatively much noise.

What is claimed is:

1. A speech determination apparatus comprising:

a frame extraction processor unit configured to extract, from an input signal having a plurality of frames, a signal portion per frame, with each signal portion having a specific duration, so as to generate a per-frame input signal that is in a time domain;

a spectrum generation processor unit configured to convert the per-frame input signal that is in a time domain into a per-frame input signal that is in a frequency domain, thereby generating a spectral pattern that is defined by a spectra of a plurality of spectrums;

a peak detection processor unit configured to determine whether an energy ratio is higher than a specific first threshold level, the energy ratio being a ratio of spectral energy of a first spectrum in the spectral pattern to subband energy in a subband that involves the first spectrum, the subband being involved in a plurality of subbands of a specific frequency band, wherein each subband has a specific bandwidth;

a speech determination processor unit configured to determine, based on a result of the determination at the peak detection processor unit, whether the per-frame input signal that is in a frequency domain is a speech segment;

a frequency averaging processor unit configured to derive average energy, in a frequency domain, based on energy of spectrums in the spectral pattern that are in the plurality of subbands; and a time-domain averaging processor unit configured to derive subband energy for each subband by averaging, in the time domain, and over the plurality of frames, the average energy derived by the frequency averaging processor unit.

2. The speech determination apparatus according to claim 1, wherein the speech determination processor unit determines that the per-frame input signal that is in a frequency domain is a speech segment if there is a specific number or more spectrums for which an energy ratio is higher than the first threshold level.

3. The speech determination apparatus according to claim 1, wherein the time-domain averaging processor unit derives the subband energy for each subband, based on energy obtained by multiplying a specific energy by an adjusting value of 1 or smaller, the specific energy being average energy of a subband that involves a spectrum for which an energy ratio is higher than the first threshold level, or being average energy of all subbands of the per-frame input signal that is in a frequency domain that involve a spectrum for which an energy ratio is higher than the first threshold level.

4. The speech determination apparatus according to claim 1, wherein the frequency averaging processor unit excludes a particular spectrum or particular spectra from the averaging, in the time domain, and over the plurality of frames, of the average energy derived by the frequency averaging processor unit, the particular spectrum being a spectrum for which an energy ratio is higher than the first threshold level, the particular spectra being the particular spectrum and spectra next to the particular spectrum.

5. The speech determination apparatus according to claim 1, wherein the time-domain averaging processor unit excludes particular average energy from the averaging, in the time domain, and over the plurality of frames, of the average energy derived by the frequency averaging processor unit, where the particular average energy is average energy in a subband that involves a spectrum for which an energy ratio is higher than the first threshold level, or where the particular average energy is average energy of all subbands of the per-frame input signal that is in the frequency domain that involve a spectrum for which an energy ratio is higher than the first threshold level.

6. The speech determination apparatus according to claim 1, wherein a second threshold level unequal to the first threshold level is provided for determining whether to include the average energy derived by the frequency averaging processor unit in the averaging, in the time domain, and over the plurality of frames, of the average energy derived by the frequency averaging processor unit, wherein the time-domain averaging processor unit excludes particular average energy from the averaging, in the time domain, and over the plurality of frames, of the average energy derived by the frequency averaging processor unit, the particular average energy being average energy in a subband involving a spectrum for which an energy ratio is higher than the second threshold level, or the particular average energy being average energy of all subbands of the per-frame input signal that is in the frequency domain that involve a spectrum for which an energy ratio is higher than the second threshold level.

7. The speech determination apparatus according to claim 1, wherein the spectrum generation processor unit generates a spectral pattern in a range from at least 200 Hz to 700 Hz.

8. The speech determination apparatus according to claim 1, wherein the specific bandwidth is in a range from 100 Hz to 150 Hz.

9. A speech determination method comprising the steps of:

extracting, by a frame extraction processor unit, from an input signal having a plurality of frames, a signal portion per frame, with each signal portion having a specific duration, so as to generate a per-frame input signal that is in a time domain;

converting, by a spectrum generation processor unit, the per-frame input signal that is in a time domain into a per-frame input signal that is in a frequency domain, thereby generating a spectral pattern that is defined by a spectra of a plurality of spectrums;

determining, by a peak detection processor unit, whether an energy ratio is higher than a specific first threshold level, the energy ratio being a ratio of spectral energy of a first spectrum in the spectral pattern to subband energy in a subband that involves the first spectrum, the subband being involved in a plurality of subbands of a specific frequency band, wherein each subband has a specific bandwidth;

determining, by a speech determination processor unit, and based on a result of the determination by the peak detection processor unit, whether the per-frame input signal that is in a frequency domain is a speech segment;

deriving, by a frequency averaging processor unit, average energy, in a frequency domain, based on energy of spectrums in the spectral pattern that are in the plurality of subbands; and deriving, by a time-domain averaging unit, subband energy for each subband by averaging, in the time domain, and over the plurality of frames, the average energy derived by the frequency averaging processor unit.

10. The speech determination method according to claim 9, wherein it is determined that the per-frame input signal that is in a frequency domain is a speech segment if there is a specific number or more spectrums for which an energy ratio is higher than the first threshold level.

11. The speech determination method according to claim 9, wherein the subband energy is derived for each subband based on energy obtained by multiplying a specific energy by an adjusting value of 1 or smaller, the specific energy being average energy of a subband that involves a spectrum for which an energy ratio is higher than the first threshold level, or being average energy of all subbands of the per-frame input signal that is in a frequency domain that involve a spectrum for which an energy ratio is higher than the first threshold level.

12. The speech determination method according to claim 9, wherein the subband-energy deriving step excludes a particular spectrum or particular spectra from the averaging, in the time domain, and over the plurality of frames, of the average energy derived by the frequency averaging processor unit, the particular spectrum being a spectrum for which an energy ratio is higher than the first threshold level, the particular spectra being the particular spectrum and spectra next to the particular spectrum.

13. The speech determination method according to claim 9, wherein the subband-energy deriving step excludes particular average energy from the averaging, in the time domain, and over the plurality of frames, of the average energy derived by the frequency averaging processor unit, where the particular average energy is average energy in a subband that involves a spectrum for which an energy ratio is higher than the first threshold level, or where the particular average energy is average energy of all subbands of the per-frame input signal that is in the frequency domain that involve a spectrum for which an energy ratio is higher than the first threshold level.

14. The speech determination method according to claim 9, wherein a second threshold level unequal to the first threshold level is provided for determining whether to include the average energy derived by the frequency averaging processor unit in the averaging, in the time domain, and over the plurality of frames, of the average energy derived by the frequency averaging processor unit, wherein the subband-energy deriving step excludes particular average energy from the averaging, in the time domain, and over the plurality of frames, of the average energy derived by the frequency averaging processor unit, the particular average energy being average energy in a subband involving a spectrum for which an energy ratio is higher than the second threshold level, or the particular average energy being average energy of all subbands of the per-frame input signal that is in the frequency domain that involve a spectrum for which an energy ratio is higher than the second threshold level.

* * * * *